US008322892B2

(12) United States Patent
Scordino et al.

(10) Patent No.: US 8,322,892 B2
(45) Date of Patent: Dec. 4, 2012

(54) HEAT SINK AND LIGHTING DEVICE COMPRISING A HEAT SINK

(75) Inventors: Alessandro Scordino, Dolo (IT); Nicole Breidenassel, Regensburg (DE); Giovanni Scilla, Regensburg (DE)

(73) Assignee: Osram AG, Munich (DE)

( * ) Notice: Subject to any disclaimer, the term of this patent is extended or adjusted under 35 U.S.C. 154(b) by 362 days.

(21) Appl. No.: 12/746,533

(22) PCT Filed: Dec. 7, 2007

(86) PCT No.: PCT/EP2007/010691

§ 371 (c)(1),
(2), (4) Date: Jun. 7, 2010

(87) PCT Pub. No.: WO2009/071111

PCT Pub. Date: Jun. 11, 2009

(65) Prior Publication Data

US 2010/0259935 A1 Oct. 14, 2010

(51) Int. Cl.
*F21V 29/00* (2006.01)
*F21V 29/02* (2006.01)
*H01J 61/52* (2006.01)

(52) U.S. Cl. ..... 362/294; 362/264; 362/547; 362/373; 362/218; 313/24; 313/44; 313/45

(58) Field of Classification Search ..... 362/373, 362/547, 218, 264, 294; 313/41–46
See application file for complete search history.

(56) References Cited

U.S. PATENT DOCUMENTS

| | | | | |
|---|---|---|---|---|
| 3,639,751 | A | 2/1972 | Pichel | |
| 6,511,209 | B1 * | 1/2003 | Chiang | 362/294 |
| 7,144,140 | B2 * | 12/2006 | Sun et al. | 362/373 |
| 7,610,947 | B2 * | 11/2009 | Wang et al. | 165/80.3 |
| 7,837,363 | B2 * | 11/2010 | Liu | 362/373 |
| 7,918,587 | B2 * | 4/2011 | Hsu et al. | 362/294 |
| 8,057,071 | B2 * | 11/2011 | He et al. | 362/294 |
| 8,057,075 | B2 * | 11/2011 | Horng et al. | 362/373 |
| 2005/0111234 | A1 | 5/2005 | Martin et al. | |
| 2006/0290891 | A1 * | 12/2006 | Wang et al. | 353/52 |
| 2007/0268703 | A1 | 11/2007 | Gasquet et al. | |
| 2012/0188745 | A1 * | 7/2012 | Yoneda | 362/84 |

FOREIGN PATENT DOCUMENTS

| | | | |
|---|---|---|---|
| DE | 102004025624 | A1 | 12/2005 |
| EP | 1860707 | A1 | 11/2007 |
| JP | 2002298608 | A | 10/2002 |
| WO | 2007069119 | A1 | 6/2007 |

OTHER PUBLICATIONS

International Search Report of PCT/EP2007/010691 mailed Sep. 10, 2008.
English language abstract for DE 102004025624 A1.
English language abstract for JP 2002298608A.

* cited by examiner

*Primary Examiner* — Mariceli Santiago

(57) ABSTRACT

A heat sink is provided. The heat sink may include an open cavity formed by a cavity wall, a cavity bottom wall thereof including a light source region adapted to have a light source mounted thereon and a lateral cavity wall thereof including a reflection region adapted to reflect light emitted from the light source; a heat spreading and dissipation structure covering at least part of an exterior of the heat sink including a bottom region and a lateral region, the heat spreading and dissipation structure including a plurality of vertically aligned fins; an air guidance structure adapted to separate the heat sink from an air flow generator; and at least one mounting column for attaching the heat sink to a lighting device.

15 Claims, 15 Drawing Sheets

HEAT SINK AND LIGHTING DEVICE COMPRISING A HEAT SINK

RELATED APPLICATIONS

The present application is a national stage entry according to 35 U.S.C. §371 of PCT application No.: PCT/EP2007/010691 filed on Dec. 7, 2007.

TECHNICAL FIELD

Various embodiments relate to a heat sink, e.g. a heat sink adapted for operation with a forced air flow generator, and a lighting device including such a heat sink.

BACKGROUND

In general, cooling of a high power light source, e.g., comprising a light emitting diode (LED), assembled at a small area, i.e. with a high power density, is desired but difficult to achieve. A small available area further necessitates an efficient utilization of available space between other functional parts of the lighting device, e.g., housing, optics, driver boards etc. Also, there is required a user friendly thermal management regarding noise and warm air flow.

To achieve these conflicting goals, known lighting devices, like LED lamps, operate at a lower power, may divide the brightness and hence the power dissipation by arranging LEDs on a comparatively large area, and mostly use passive heat sinks. Passive heat sinks are typically arranged laterally around or below a light source and provide relatively widely spaced cooling fins creating air flow channels reaching from bottom to the very top to allow natural convection; the warm air exit is typically around the fins with a warm air tail opposite to the direction of gravity. Some lighting devices, however, employ an active cooling forcing an air flow onto a heat sink in thermal connection with the hot light sources, often via a submount substrate. The heat sink is regularly a separately manufactured element fixed by a support structure, e.g., the housing. The known heat sinks employed for active cooling are attached below the heat sources facing the fan. Particularly with compact designs, the assembly and adjustment of the various parts becomes complex and costly.

SUMMARY

Various embodiments provide a high power lighting system that is compact, reliable, user-friendly and easy to assemble.

The heat sink comprises an illumination region, the illumination region comprising a light source region adapted to have a light source mounted thereon and a reflection region adapted to reflect light emitted from the light source.

By combining a light source function and the heat sink, the manufacture and assembly complexity, and thus costs, are greatly reduced.

Advantageously, the light source comprises a LED submount/LED module for effective illumination and easy assembly. A submount (or module) uses a substrate comprising one or more single LEDs or LED-Chips, e.g. a cluster of differently coloured LEDs (e.g., using red, blue, and green LEDs, or white LEDs).

Advantageously, the illumination region further comprises an optics fixing means for fixing at least one optical element. This facilitates assembly even more.

Advantageously, the optical element comprises a Fresnel lens and/or a micro lens array and/or a light transmissive cover.

For easy manufacture the reflection region advantageously comprises a polished or painted surface of the heat sink.

However, the reflection region may also comprise a reflective layer.

Particularly advantageous is a heat sink wherein the cavity wall comprises a reflection area for reflecting light from the light source outside of the cavity. Advantageously, at least the lateral wall of the cavity comprises a reflection area or region, wherein the reflexion area most advantageously covers most or all of the lateral cavity wall. Advantageously, the cavity bottom wall comprises the light source region Especially for effective cooling as well as a good illumination property, the following dimensions of the cavity have been found to be advantageous:

a height h of the cavity ranging between 30 mm and 80 mm, particularly about 60 mm;

a width L1 of the bottom of the cavity ranging between 20 mm and 60 mm, particularly about 40 mm;

a width L2 of the top of the cavity ranging between 80 mm and 120 mm, particularly about 100 mm;

a ratio Rt of the width L2 and the width L1 being in the range of $1.25 \leqq Rt \leqq 5$;

a thickness Dw of the lateral cavity wall being in the range of $0.5\ mm \leqq Dw \leqq 10\ mm$.

Advantageously, the heat sink comprises a material having a thermal conductivity in the range of 150-240 W/(m·K).

Advantageously, this material comprises Cu, Al, Mg, or an alloy thereof.

For a good heat distribution from the light source proper (LED chip) to the heat sink, advantageously a substrate of the at least one submount comprises a material having a thermal conductivity higher than 240 W/(m·K).

Advantageously, the substrate of the at least one submount comprises Cu or a Cu alloy as a material.

Advantageously, the heat sink comprises at least one mounting column for attaching the heat sink to a lighting device. This further reduces assembly and manufacturing costs and adds to an easy adjustment.

Advantageously, the at least three mounting columns are arranged in a non-symmetrical manner to allow cut-outs.

Advantageously, the mounting columns are extending in a direction opposite to an illumination direction (downwards).

Advantageously, at least one of the mounting columns comprises a borehole adapted to be inserted by a fastening element.

Advantageously, the borehole at least partially comprises a threaded area for easy fastening.

Advantageously, at least one of the mounting columns comprises an attachment region adapted to have attached thereon a coaxial plastic part or element for stable mounting, as well as for low tolerances, mechanical absorption and electrical insulation.

Advantageously, the at least one mounting column, at its free end, comprises an opening of the borehole as well as the attachment region.

Advantageously, the at least one mounting column is adapted to secure at least one printed circuit board. This also reduces assembly and manufacturing costs and adds to an easy adjustment.

Advantageously, the heat sink further comprises a heat spreading and dissipation structure covering at least part of an exterior of the heat sink including a bottom region and a lateral region. Advantageously, the heat spreading and dissipation structure is covered on top to avoid an airflow in the illumination direction.

Advantageously, the heat spreading and dissipation structure comprises at least one air flow channel leading from the bottom region to the lateral region, the air flow channel comprising a lateral exit. By directing the air flow to the lateral region, a compact and user friendly lighting device can be achieved since firstly a flow of warm air in direction of the light emission is avoided, secondly the size of the optical emission area may be made larger, and thirdly an only moderate noise is achievable despite using an active cooling from the fact that for a limited maximum diameter the overall grid area can be larger at the side than at the front; from this follows a lower air flow through each grid opening, which results in lower noise. These advantages are particularly pronounced and achievable by using an active cooling generator (forced air flow generator) to create an air flow through the dissipation structure. However, the heat sink may also be used for natural convection.

Advantageously, the heat spreading and dissipation structure comprises a plurality of vertically aligned fins for ensuring easy assembly and a strong air flow.

Advantageously, each air flow channel at least partially comprising two adjacent fins and a portion of the cavity wall bordered by the two adjacent fins. This leaves a lateral open side that may or may not be covered, as desired.

Advantageously, the fins are arranged in a in rotational symmetric relationship to ensure even heat distribution.

Particularly for effective cooling with a forced air flow, the following dimensions of the fins have been found to be advantageous:

a circumferential distance between two adjacent fins (width of the air flow channels) is in the range of $0.4\ \text{mm} \leqq C1 \leqq 8\ \text{mm}$;

a thickness is in the range of $0.1\ \text{mm} \leqq F1 \leqq 3\ \text{mm}$;

a lateral length is in the range of $5\ \text{mm} \leqq F2 \leqq 40\ \text{mm}$;

an overall height Hc is in the range of $Hb \leqq Hc \leqq h+Hb$.

The following dimensions of the heat spreading and dissipation structure of the heat sink have been found to be advantageous:

a height He of the lateral exit being in the range of $0.1 \cdot Hc \leqq He \leqq 0.6 \cdot Hc$.

Although the shape of the fins is not restricted to any particular design, it is deemed advantageously if the fins at least partially show a rectangular, curved and/or pointed cross-section, e.g., a triangular cross-section.

Advantageously, the fins at the bottom of the cavity wall are radially extending in a straight pattern.

Advantageously, the base fins at the bottom of the cavity wall may also be radially extending in a squirl pattern.

Advantageously, the at least one air flow channel comprises an enlarged air flow cross section at or in the vicinity of the lateral air outlet opening.

Advantageously, the heat sink comprises a solid heat sink base extending from the light source region to the exterior and protruding from the cavity wall; and wherein the heat spreading and dissipation structure is in thermal connection with the heat sink base. By such a design, a particularly effective heat conduction and dissipation is achieved. The solid heat sink base comprises enough volume to fastly guide heat away from the heat sources. By the protruding solid heat sink and the heat spreading and dissipation structure being in thermal connection with the heat sink base, a strong thermal conduction over a large area into the heat spreading and dissipation structure is achieved.

For good heat distribution into the fins and smooth air flow guidance, the heat sink base advantageously has a tapered shape with the base positioned at the light source region.

Advantageously, the tapered shape of the heat sink base is that of a cone. Advantageously, the conical shape of the heat sink base is that of a truncated cone. In general, the base of a cone may have any shape, and the apex may lie anywhere. However, it is often assumed that the base is bounded and has nonzero area, and that the apex lies outside the plane of the base. Circular cones and elliptical cones have, respectively, circular and elliptical bases. If the axis of the cone is at right angles to its base then it is said to be a right cone, otherwise it is an oblique cone. A pyramid is a special type of cone with a polygonal base.

Especially for effective heat distribution and smooth air guidance, the following dimensions of the heat sink base have been found to be advantageous:

a base width Lt of the heat sink base being in the range of $L1 \leqq Lt \leqq 1.5 \cdot L1$;

an apex width Lc of the heat sink base being in the range of $0 \leqq Lc < L1$;

a height Hb of the heat sink base being in the range of $0.05 \cdot L1 \leqq Hb < 0.5 \cdot L1$.

To avoid leakage of air and hence for a stronger air flow through the air flow channels, the heat spreading and dissipation structure is at last partially covered by an air baffle.

The object is also achieved by a lighting device, comprising such a heat sink. The lighting device can be designed to be high powered, effectively cooled, compact, and quiet.

Particularly advantageous is a lighting device comprising a forced air flow generator adapted to supply a forced air flow to the heat sink, e.g. a fan or a vibrating membrane. The forced air flow generator ensures a high cooling air flow.

Advantageously, the forced air flow generator is adapted to supply an air flow to the bottom of the heat sink.

Advantageously, the air flow generator is positioned below the heat sink.

Advantageously, the air flow generator is spaced apart from the heat sink by an air guidance structure to avoid turbulences and air disruption, which would lower the cooling performance and enlarge the noise.

Advantageously, the air guide structure comprises an open space.

Advantageously, the open space may have a basic shape of a straight tube or may be hourglass shaped.

For a high degree of compactness, further comprising a support adapted to support at least one printed circuit board.

Advantageously for compactness, the support is of circular shape and positioned around one out of the air guidance structure and the forced air flow generator.

For easy assembly and alignment, the support advantageously comprises at least one throughole for receiving one of the mounting columns.

Advantageously for compactness, at least one PCB is perpendicularly attached to the support.

Advantageously for compactness, the a plurality of PCBs is arranged symmetrically around a longitudinal axis of the lighting device.

Advantageously, the a borehole of the forced air flow generator and a borehole one of the mounting columns are aligned to receive a common fastening element.

The above heat sink and lighting device gain significant advantage by: a high level of integration (e.g., an integration between mounting parts and functional parts like fan, electronics, optical structures), a good mechanical stability, an efficient thermal dissipation system, compactness, an assembling flexibility and interconnection with the heat sink (e.g., easy assembling and disassembling of the mounted heat sink), a multifunctional fixing structure, and no visible fixing structure.

BRIEF DESCRIPTION OF THE DRAWINGS

The invention is further detailed in the following description of exemplary embodiments taken in conjunction with the accompanying schematic figures. It is to be understood that the invention is not limited to these embodiment.

DETAILED DESCRIPTION

Figure 1:
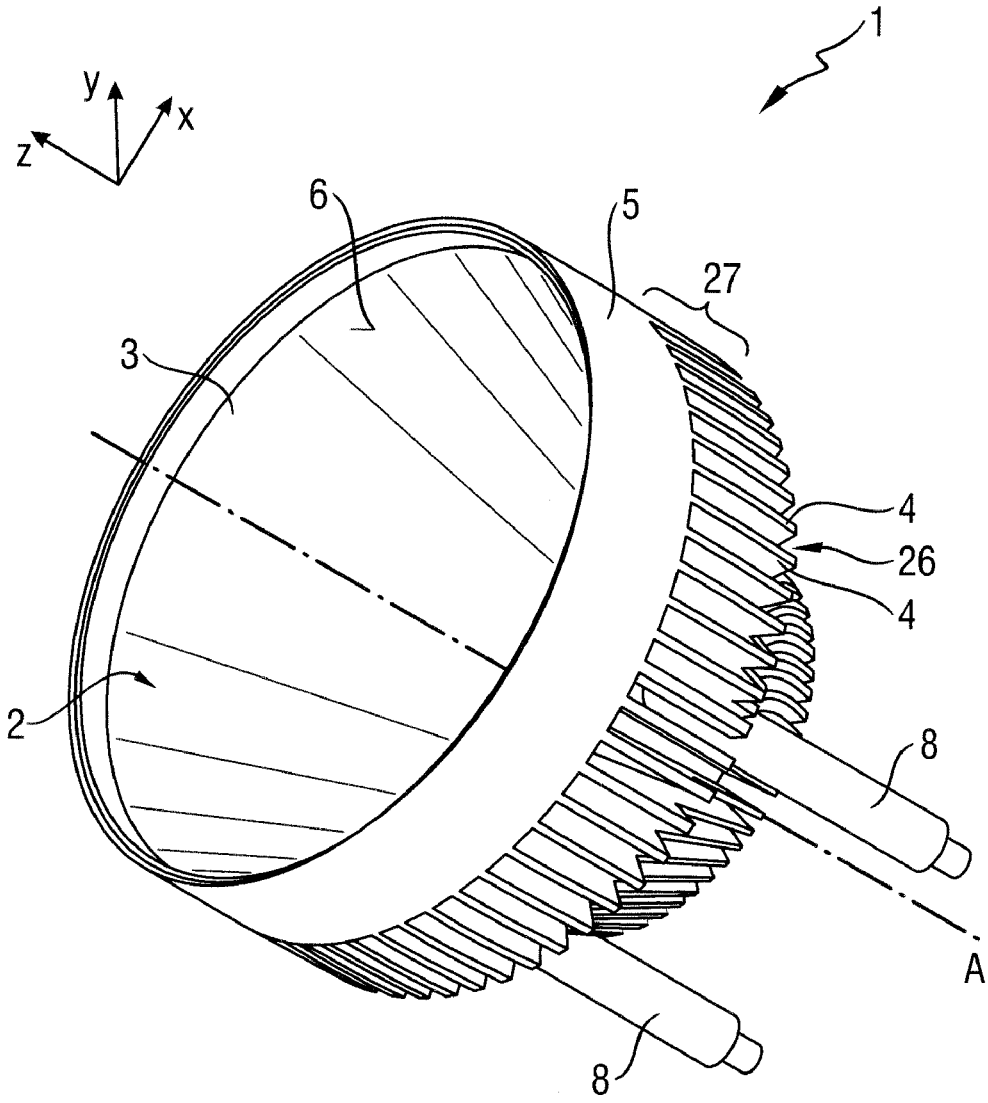
FIG. 1 shows a tilted view of a heat sink.
Figure 2:
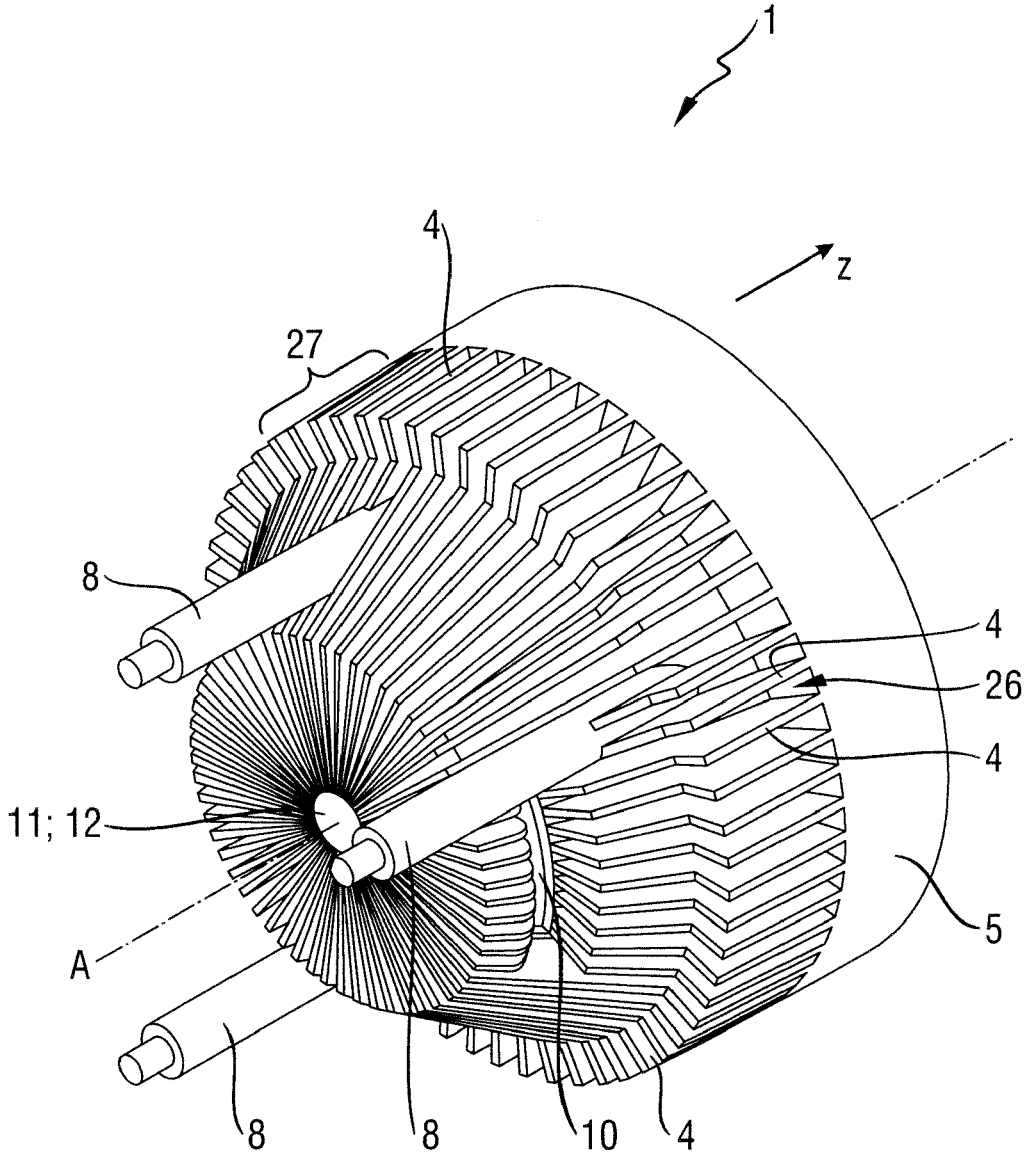
FIG. 2 shows the heat sink of FIG. 1 from the opposite direction.
Figure 3:
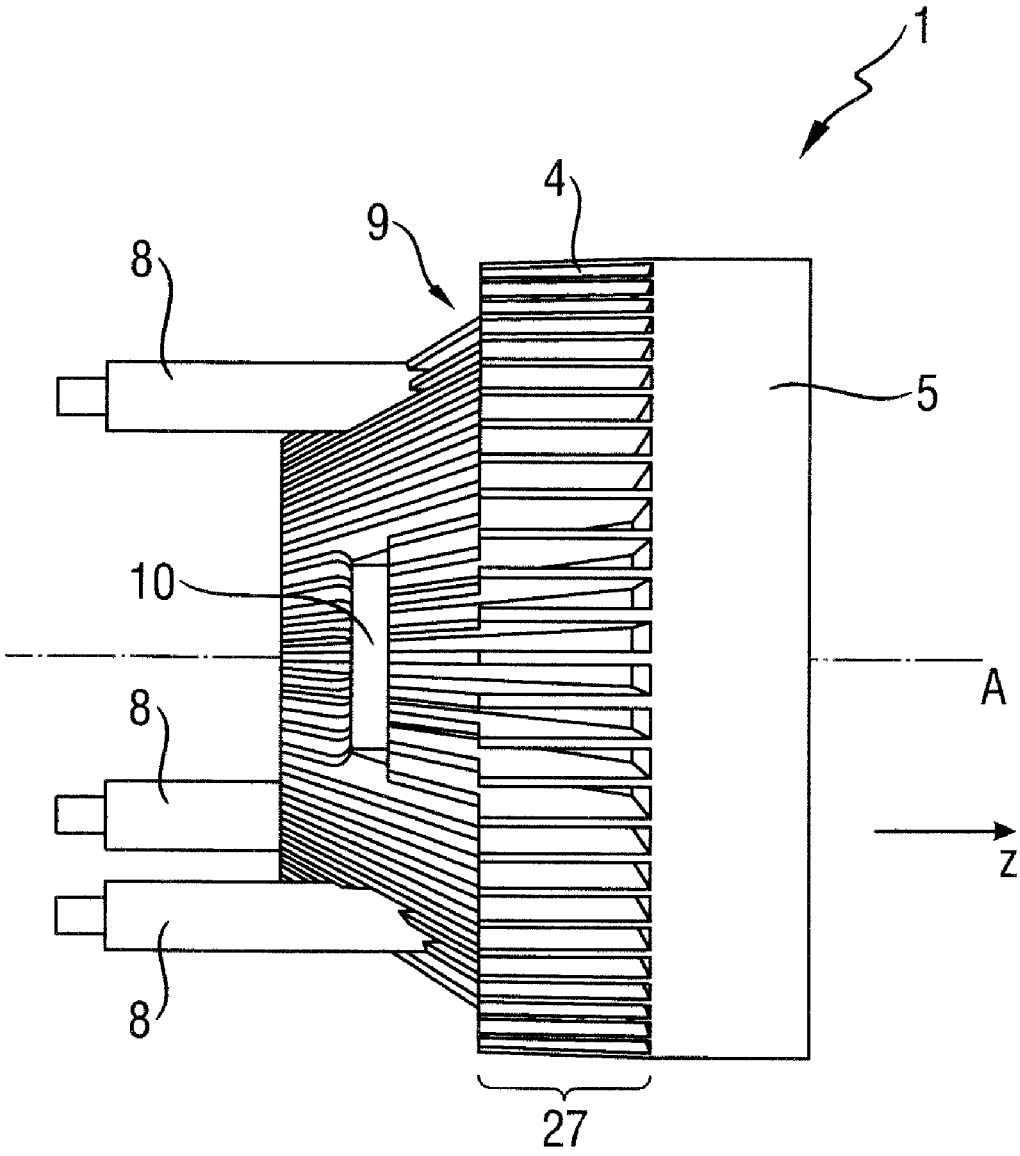
FIG. 3 shows a side view of the heat sink of FIG. 1.
Figure 4:
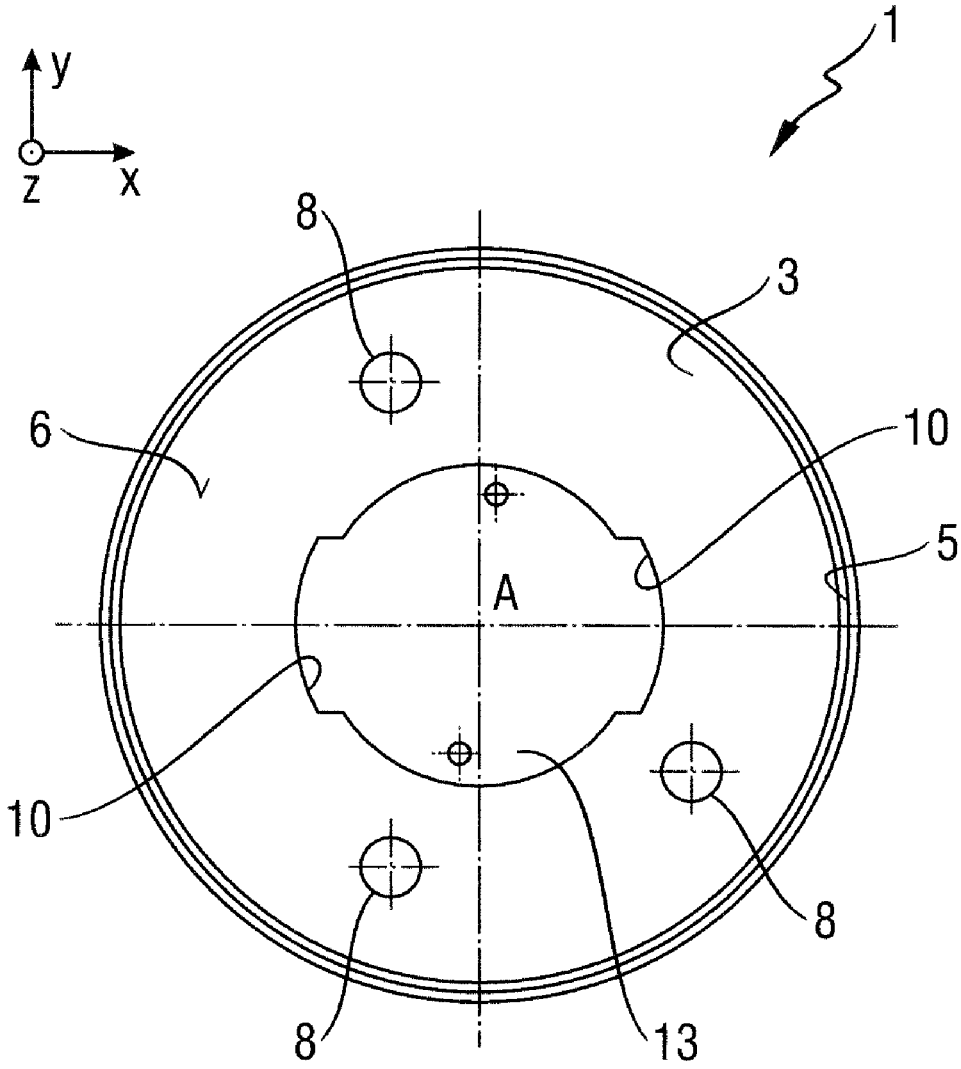
FIG. 4 shows a top view of the heat sink of FIG. 1.

The following detailed description refers to the accompanying drawings that show, by way of illustration, specific details and embodiments in which the invention may be practiced.

FIG. 1 to FIG. 4 show a heat sink 1 comprising not only a cooling property but also an illumination property, a mechanical fixing property and an air guide property. The heat sink comprises a cup-shaped cavity 2 formed by a respective cavity wall (heat sink body) 3, namely a bottom wall 13 and a circumferential lateral wall 6.

For an effective cooling characteristic, the heat sink 1 comprises a plurality of vertically aligned fins (wings) 4 that are integrally connected to the exterior of the cavity wall 3, namely, of the bottom wall 13 and lateral wall 6. The fins 4 are connected to the wall in a rotationally symmetric manner with respect to a longitudinal axis A of the heat sink 1. Each gap between adjacent fins 4 creates a respective air flow channel 26. The top of the fins 4 (with respect to the longitudinal axis A) is covered by a circumferential projection (exterior rim) 5. The fins 4 fill a cup shaped volume which gives a very good usage of available space. A thickness of the fins 4 and of a gap/distance/channel width, resp., between the fins 4 is a trade-off between heat spread capacity and available cooling surface, as will be explained further below.

Below the bottom cavity wall 3, the fins 4 do not touch but are all connected to a common heat sink base 11 protruding downwards from the bottom of the cavity 2 and having a non-vanishing bottom area (heat sink centre) 12. The base 11 has a pyramidal cross-sectional shape for fast heat spread into the active fin zone and for smooth guidance of forced air into channels avoiding useless turbulences and hence minimizing noise. Width, thickness, and centre area are a trade-off between heat spread and fast transit of heat to the cooling surface (fins 4).

From the heat sink base 11, the fins 4 and thus the air flow channels 26 between them continuously run up along the lateral cavity walls 6 (heat sink body) to a lateral exit 27 for smooth air guidance leading to efficient air cooling and minimized noise for active cooling. In other words, the air flow channels 26 are constructed as smooth bended channels that direct air to side openings 27 in order to provide lateral, radial exit of warm air to avoid a flow of warm air in direction of the light emission. The rotational symmetric air exit 27 therefore reduces the flow rate per solid angle and minimizes the recognizable warm air flow and also moderates noise despite enhanced active cooling. To the same effect, an air channel 26 enlargement—effected by a step 9 in the outer edge of the fins 4—is provided to the end for lower pressure transit through an optional case grid. A material of the fins 4 is chosen for fast heat spread into the fins 4.

The lateral cavity wall 6, too, acts as a heat spread layer to overcome channel disruptions caused by two connector cutouts 10 and by mounting features like the mounting columns 8 shown. The thickness at least of the lateral cavity wall section 6 is a trade-off between a heat spread capacity and the width of the air flow channels, i.e., the cooling surface.

Regarding the illumination property, the bottom surface 13 of the cavity 2 is adapted to receive at least one light source, e.g., one or more LED submounts or LED modules. The thickness and choice of material for the submounts is a trade-off between cost and performance. To ensure a good heat spread away from the LED submount, the thermal conductivity of the substrate 15 is at least as high as the one of the material of the heat sink 1.

It is preferred if the coefficient $\lambda$ of the thermal conductivity of the substrate 15 of the submount/LED-module is higher than 250 W/(m·K), e.g., by using Cu or a Cu alloy as a material. It is then preferred if the coefficient $\lambda$ of the thermal conductivity of the heat sink wall 3 is between than 150 W/(m·K) and 240 W/(m·K), e.g., by using Al or Mg, or an alloy thereof, as a material. This combination is also relatively cheap thanks to the limited use of copper. Of course, other materials may be used, particularly other or more metals but also heat conducting ceramics like AlN having a typical $\lambda$ between than 180 W/(m·K) and 190 W/(m·K). Depending, inter alia, on the environment, the available space and on the amount of heat to be dissipated, at least the cavity wall 3 (or on the other side the hole the heat sink 1) may be of a well conducting material, preferably metal, with a coefficient $\lambda$ being at least about 15 W/(m·K), like stainless steel, particularly being at least about 100 W/(m·K), even more preferred to be between than 150 W/(m·K) and 450 W/(m·K), yet more preferred to be between than 150 W/(m·K) and 250 W/(m·K).

If otherwise the LED dies are to be placed directly on just one submount, the latter one must be electrically isolating, for which purpose materials of thermal conductivity smaller than 240 W/(m·K) are preferred. Also, the electrical isolation of the LED dies has to be guaranteed for independent multicolour operation. For this purpose, either a LED package serves as electrical insulation or the LED dies have to be placed on a first electrical isolating submount of as a high thermal conductivity as possible, which is e.g. AlN in the range of 180 W/(m·K). Then this LED assembly is placed on a second submount. The integration of a second submount between LED assembly and heat sink 1 is a trade-off between cooling performance and material costs.

Power lines and signal lines of the LED submount may be conducted through the connector cut-outs 10. The interior lateral surface 6 at least partly acts as a reflector wherein the reflective area may be, e.g., polished, painted, layered by material deposition or comprising a reflective foil etc. accordingly for specular or diffuse reflection. The lateral cavity wall 6 additionally comprises accommodation means for fixing optics elements, as will be described in greater detail further below. The lateral cavity wall 6 is cup shaped for best usage of available space.

Regarding the mechanical fixing property, the heat sink 1 further comprises three mounting columns 8 for fixing it to a lighting device, as will be explained in greater detail further below. The mounting columns 8 are not in a symmetric arrangement regarding axis A.

Regarding the air guide property, the heat sink 1 may further comprises air guide means for directing an air flow to other components, e.g., a driver board.

Generally it is advantageous but not essential if the heat sink 1 is an integral element, e.g. manufactured as one piece.

Figure 5:
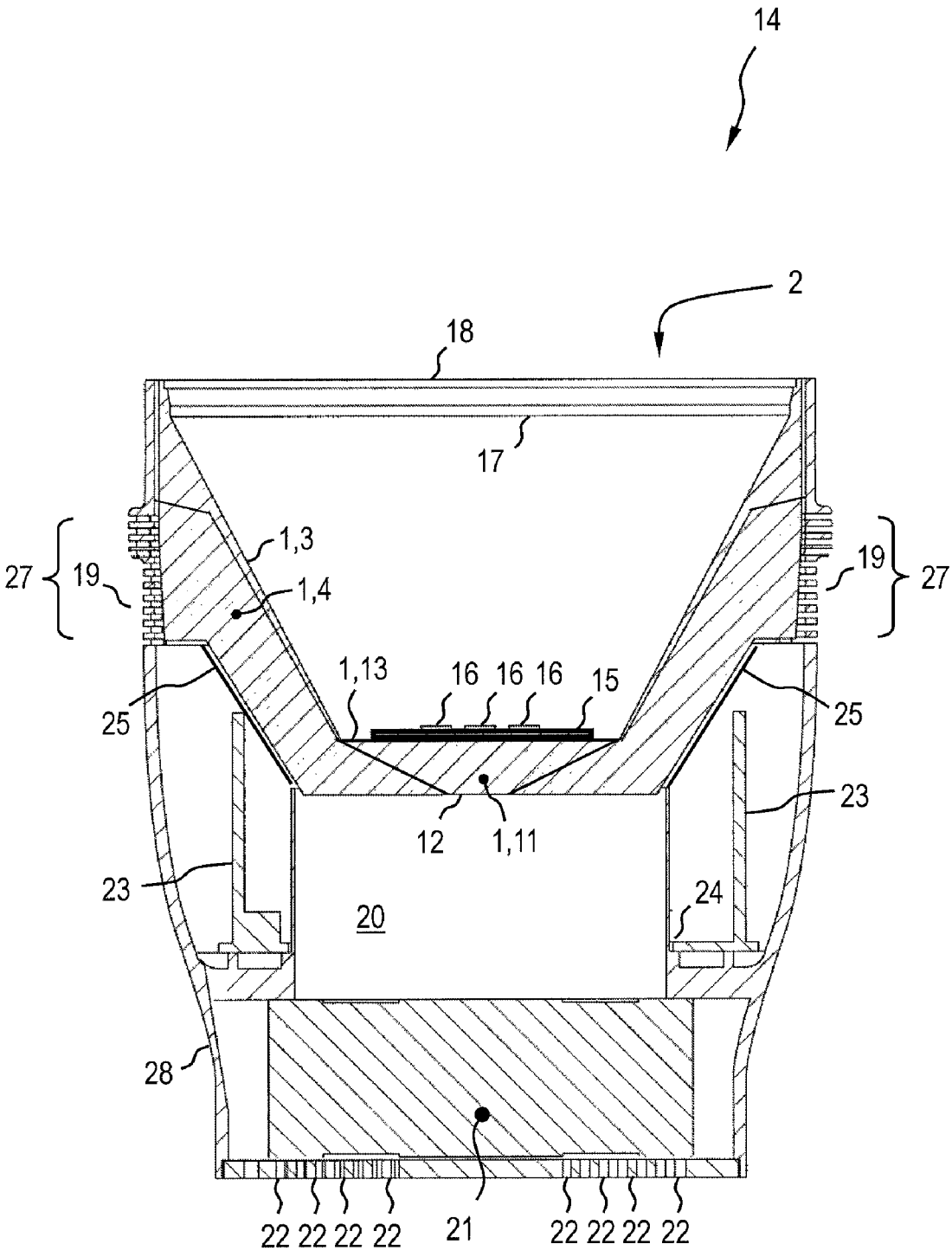
FIG. 5 shows a cross-sectional side view of a first embodiment of a lighting device comprising the heat sink of FIG. 1.

FIG. 5 shows a lighting device 14 comprising, in a housing 28, the heat sink 1 of FIG. 1 to FIG. 4.

Regarding the illumination property, the lighting device 14 further includes an illumination means within the cavity 2 comprising one LED submount in turn comprising a substrate 15 supporting a plurality of light emitting diodes, LED, 16 wherein the LED submount 15, 16 is mounted at the bottom surface 13 of the cavity 2. The illumination means also includes a top cover of the cavity 2 comprising a Fresnel lens 17 and above that a micro lens array 18. The lateral cavity surface 6, i.e., the internal surface of the lateral section of the cavity wall 3, is acting as a reflector for the light emitted by the LED-Chips 16 by reflecting this light at the surface 6, and this way enhancing the amount of light passing the lenses 17, 18. The reflector is thus no self-supporting or separate structure but part of the multifunctional heat sink 1.

Regarding the cooling property, the housing 28 circumferentially comprises lateral air outlet openings 19 adjacent to the top region (exit region) of the fins 4. In the shown embodiment, the housing 28 has no significant influence on the air flow within the heat sink 1 or on the lighting device 14 as such.

Below the heat sink 1 is located a fluid dynamic region or air guide structure 20 separating a forced air flow generator 21, e.g., a fan, from the heat sink 1. The air guide structure 20 in the present case is designed as an open space. The air guidance structure 20 the between air flow generator and the heat sink base provides space for development of the forced flow to guarantee a continuous air flow and a usage of full fan power while avoids fan noise from air disruptions. The sidewalls may be differently shaped, e.g., as a straight tube or in a sand clock shape, for efficient guidance of cool air into the heat sink channels.

Sideways with respect to the air guide structure 20 and air flow generator 21 are positioned printed circuit boards (PCB) 23 on which are placed the electrical and electronical components to control operation of the lighting device 14, e.g. an LED driver, a fan driver, and so on. The PCBs 23 are vertically placed on a circular/ring-shaped support 24 in a rotationally symmetric manner for enabling a compact design and a sufficient cooling of the PCBs 23. The ring-shaped support 24 in turn is supported by the housing 28. The ring-shaped support 24 is placed around the fan 21 achieving a high degree of compactness. Regarding the mechanical fixing property, the heat sink (heat sink structure) 1 may fix and/or fasten the ring-shaped support 24 to the housing, as will be explained in more detail below.

Covering the inclined outer perimeter of the heat sink 1, i.e., the inclined outer edges of the fins 4, is positioned an (optional) air baffle 25. Regarding the air guide property, this air baffle 25 forces the whole cooling air through the air flow channels 26 for most efficient light source cooling.

The housing 28 below the fan 21 comprises circular air intake openings 22, of which for the sake of clarity only some are provided with reference numbers.

Figure 6:
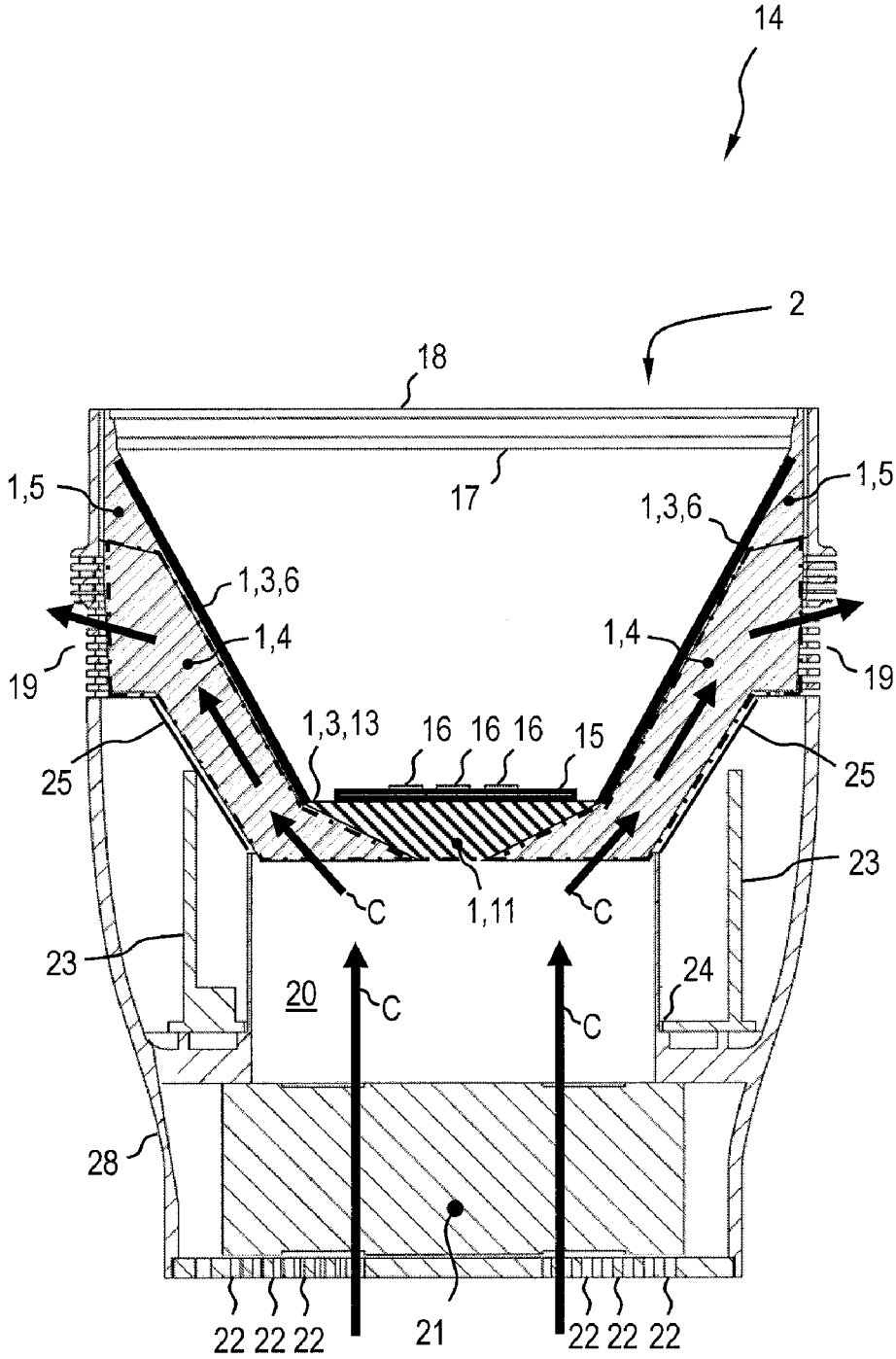
FIG. 6 shows another cross-sectional side view of the first embodiment of the lighting device of FIG. 5.

FIG. 6 shows the lighting device 14 of FIG. 5 now with: the air flow roughly indicated by arrows C; the heat sink base 11 highlighted by a hatching; the contour of the fins 4 highlighted by a dashed-dotted contour line; and the lateral cavity wall 6 emphasized.

During operation of the lighting device 14, the fan 21 draws in air through the air intake openings 22 below and creates an air flow within the housing 28 through the fluid dynamic region/air guide structure 20. The air guide structure 20 directs a mostly laminar air flow to the bottom region of the heat sink 1. There, the air enters the air flow channels created by a respective gap between adjacent fins 4. At the bottom of the heat sink 1, the air is diverted sideways thanks, inter alia, to the protruding tapered cross-sectional shape of the heat sink base 11 that thus also functions as an air guidance element. The air is then flowing up through the air flow channels until it is blown outside through the lateral air exit openings 19 and the air flow exit 27, respectively. The fins 4 are covered on top by the laterally protruding heat sink rim 5. The lateral rotational symmetric arrangement of the air exit 27 and lateral exit openings 19, resp., especially ensures a compact design, minimizes the recognizable warm air flow in the direction of the light emission, reduces the flow rate per solid angle and thus moderates noise despite enhanced active cooling. The air baffles 25 around the heat sink fins are only optional; they force the whole cooling air through the heat sink channels for most efficient light source cooling.

Without the air baffles 25, a moderate cooling of a PCB 23 by means of leakage air from the heat sink's air flow channels is advantageously provided, contributing to the air guide property.

The shown cooling design is very efficient since the fins 4 are in good thermal contact with the LED-submount 15, 16. This is achieved firstly by connecting the fins 4 to the heat sink base 11 over a relatively long length while at the same time the base 11 efficiently transports the heat away from the LED-submount 15, 16 because of its relatively large volume. Also, the cavity walls 3 show a good heat spreading characteristics such that the fins 4 are additionally getting a significant thermal load from the cavity walls 3. This is especially useful for fins 4 in the region of the cut-outs 10 where the depth and therefore the heat spread capacity of the respective fins is greatly diminished but the fins 4 are still able to significantly contribute to the heat transport. In general, the dimensioning of, inter alia, the volume of the heat sink base 11 (e.g., its height, width, and size) and of the thickness of the cavity walls 3 is a balance between a strong heat spread characteristic made possible by a large heat spread volume and the desire to build a low-cost and lightweight lighting device.

Figure 7:
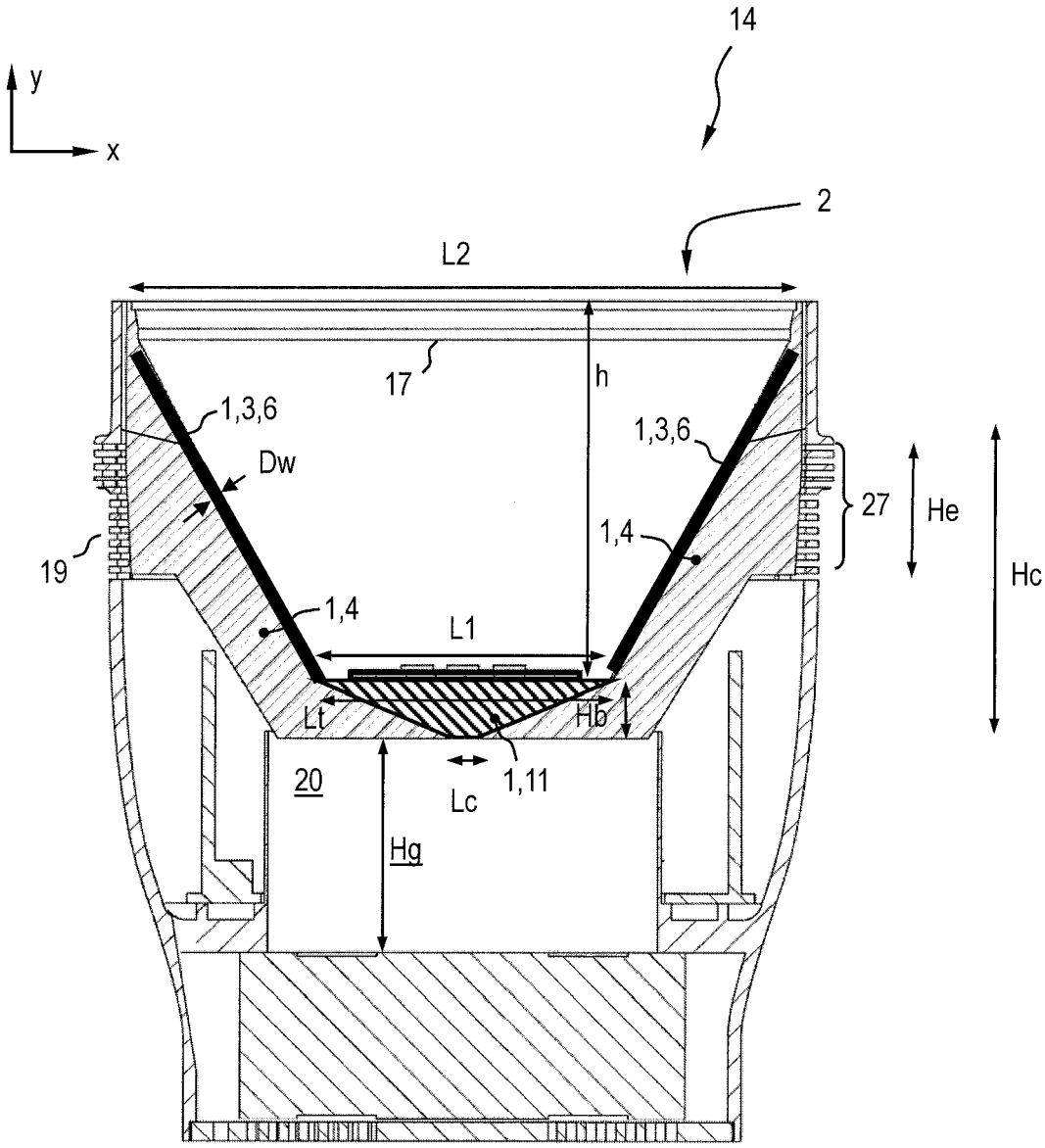
FIG. 7 shows even another cross-sectional side view of the first embodiment of the lighting device of FIG. 5.

FIG. 7 shows the lighting device 14 of FIG. 5 and FIG. 6 with several exemplary design dimensions. The lighting device 14 is especially designed to use a light source power of 40 W+/−30% with an area of the device 14 of 10-40 mm in diameter.

At the optics zone, a diameter L1 at the bottom 13 of the cavity 2 of about 40 mm, a diameter L2 at the top of the cavity 2 of about 100 mm, and a height h of the cavity walls 3 of about 60 mm have been found to give very good illumination characteristics.

Also, it has been found that—if used not for other but thermal reasons—the material of the submount/substrate 15 shows a better thermal performance than the one used for the heat sink 1. Its width is advantageously to be L1 at a maximum while its thickness (along the longitudinal axis) is preferred to be in the range of 0.5 mm to 3 mm. An advantageous material for the heat spread core is copper.

For the heat sink base 11 of truncated conical shape it has been found to be advantageous that a base top width Lt is in the range of: $L1 \leqq Lt \leqq 1.5 \times L1$; a width Lc of the base centre 12 is in the range of: point tip$\leqq Lc < L1$; and a base 11 height Hb is in the range of: $0.05 \times L1 \leqq Hb \leqq 0.5 \times L1$.

Figure 8:
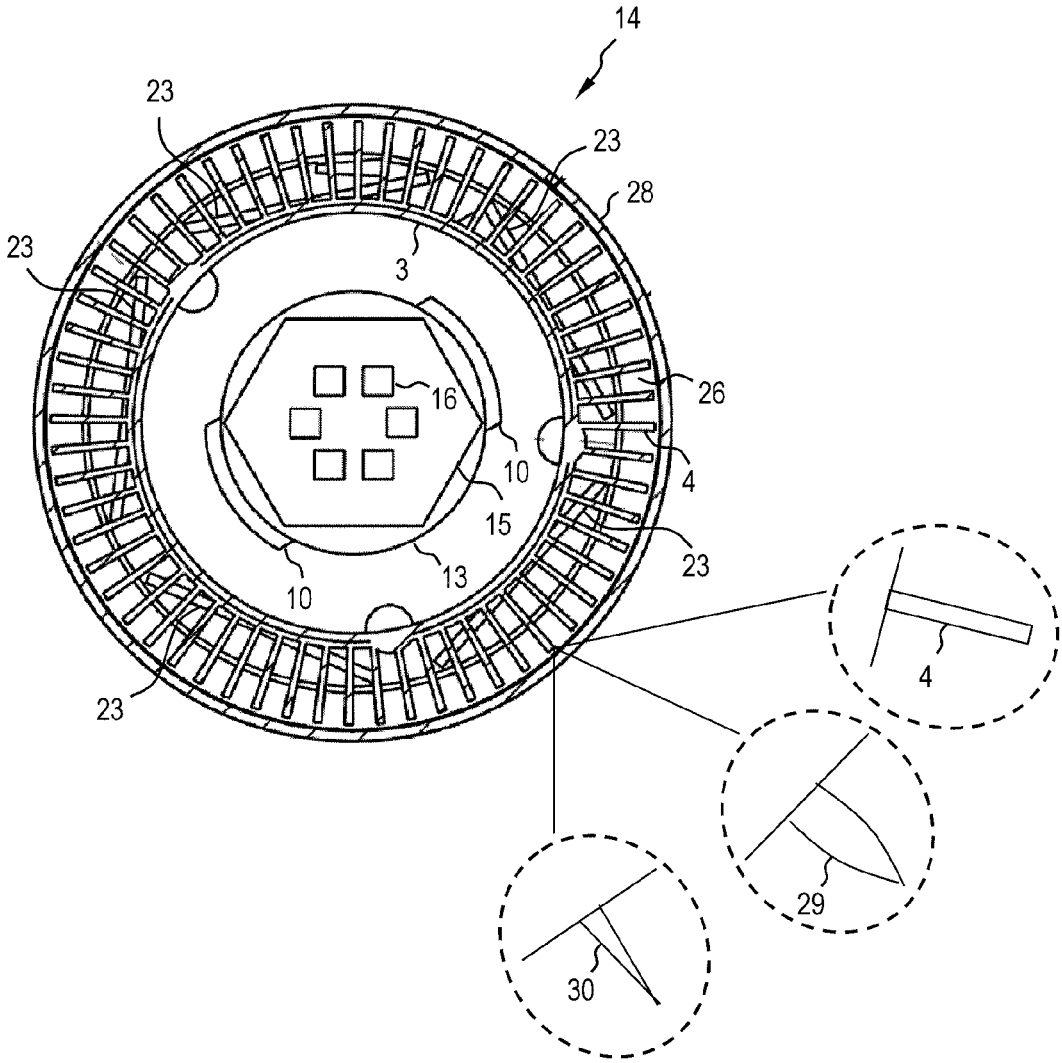
FIG. 8 shows a horizontal cross-section of the lighting device of FIG. 5.
Figure 9:
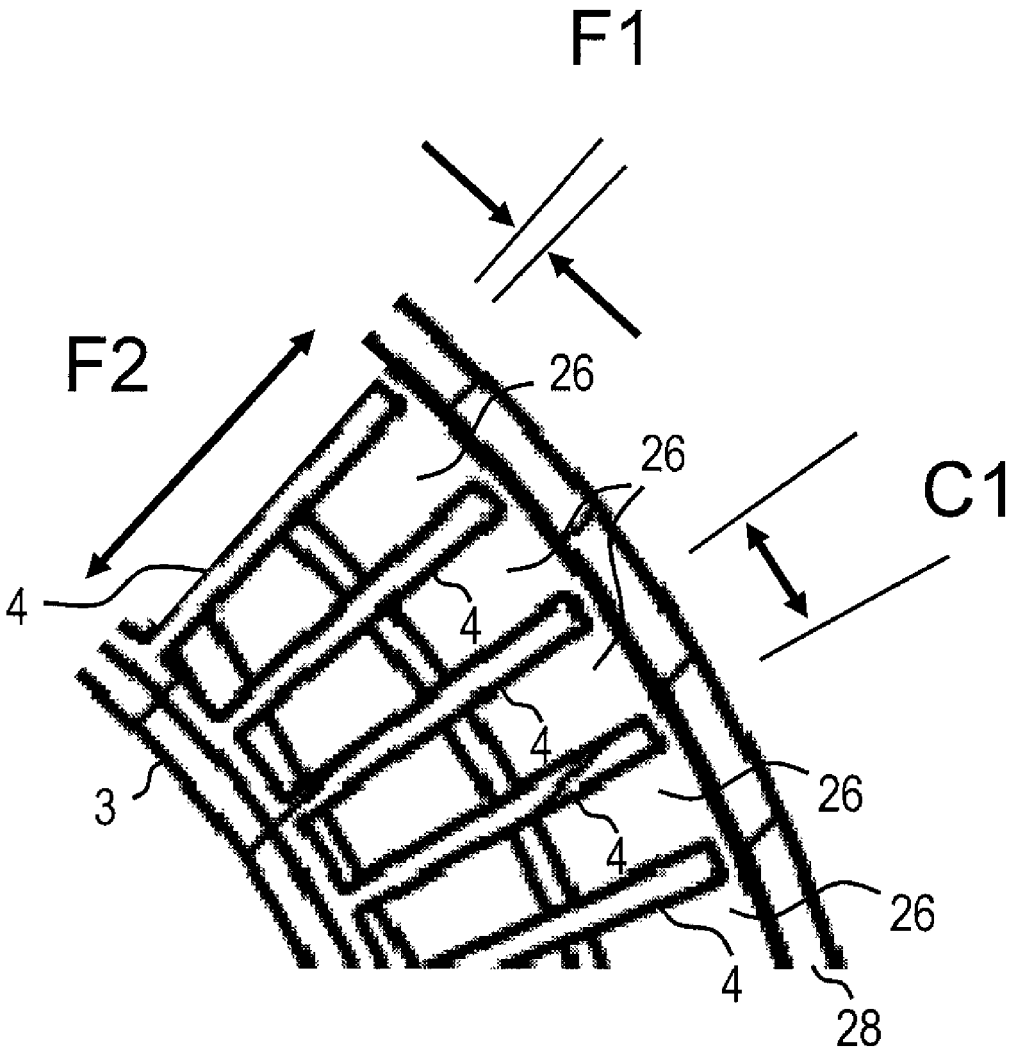
FIG. 9 shows an enlarged cut-out of FIG. 8.

FIG. 8 and—as a detailed view—FIG. 9 show a horizontal cross-section between the bottom 13 of the cavity 2 and the air exits 19. For the fins 4 and the air flow channels 26 created in between it has been found to be advantageous that a thickness F1 of a fin 4 is in the range of: 0.1 mm$\leqq$F1$\leqq$3 mm; a length F2 of a fin 4 is in the range of: 5 mm$\leqq$F2$\leqq$40 mm; and a thickness C1 of an air flow channel 26 is in the range of: 0.4 mm$\leqq$C1$\leqq$8 mm.

Now returning to FIG. 7 it has been found to be advantageous that an overall height Hc of an air flow channel 26 is in the range of $Hb \leqq Hc \leqq h+Hb$. The height He of the lateral air flow exit 27 is advantageously in the range of $0.1 \times Hc \leqq He \leqq 0.6 \times Hc$.

The thickness Dw of the cavity wall 3 is preferably in the range of 0.5 mm$\leqq$Dw$\leqq$10 mm.

The height Hg of the air guide structure 20 is preferably in the range between a half of the height of the forced air flow generator, here: the fan 21, and twice the height of the forced air flow generator.

The exact dimensions depend, inter alia, on the available space, spatial demand for optics, driver and the requested outline, and on the total power and power density from the light source, and may vary accordingly.

FIG. 8 also shows the position of the five PCBs 23 arranged in a symmetrical manner, and further the LED submount with its LEDs 16 mounted on the substrate 15 placed at the bottom 13. Not shown are power and signal lines connecting the submount 15, 16 through the connector cut-outs 10.

As indicated by the zoomed view of FIG. 9, the fins may be differently shaped, although all preferably being of the shape. For example, the fins 4 may be of rectangular cross-sectional shape, the fins 29 may be of curved and tapered shape, or the fins 30 may be of triangular shape. Other forms are also within the range of this invention.

Figure 10:
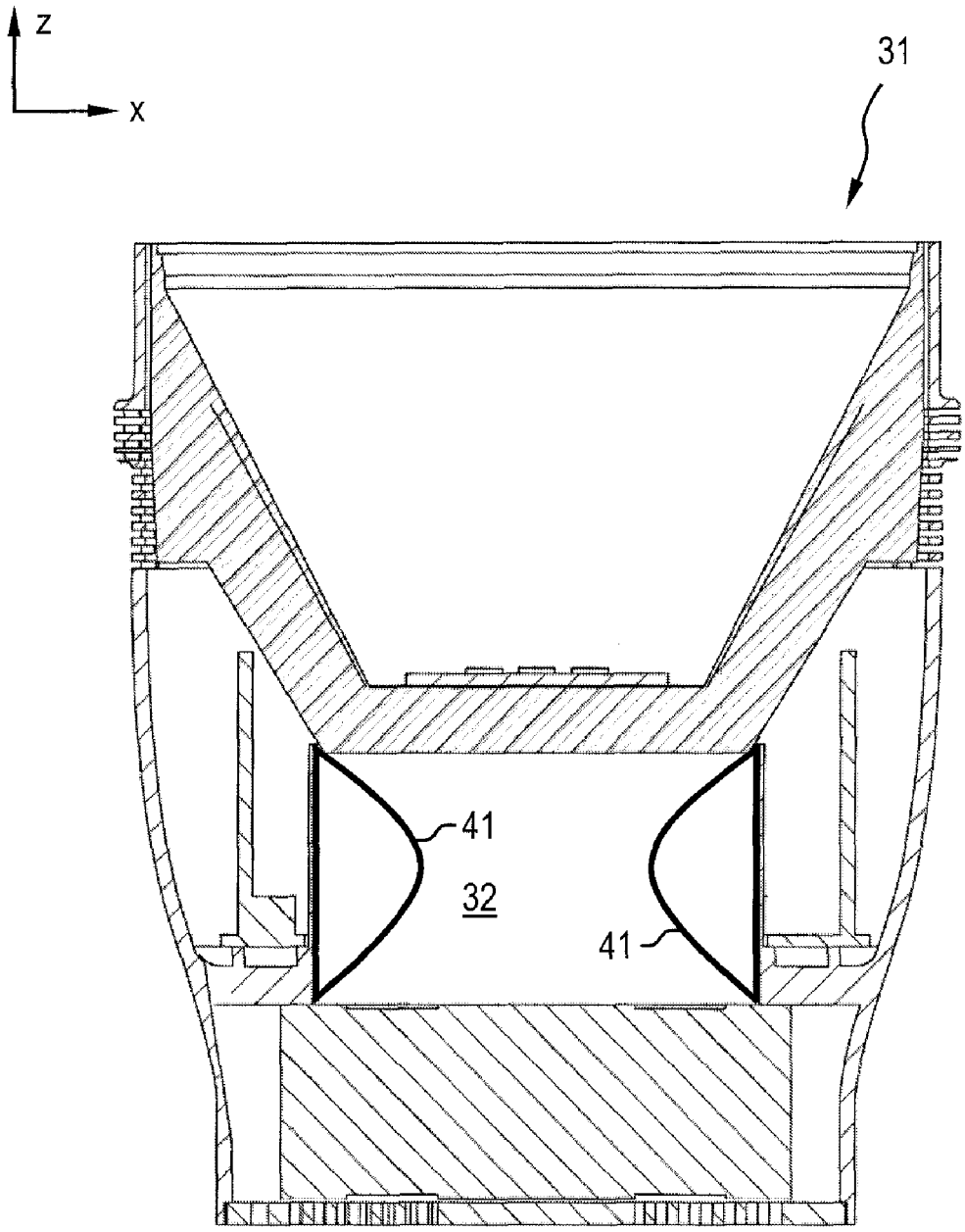
FIG. 10 shows a cross-sectional side view of a second embodiment of a lighting device comprising the heat sink of FIG. 1.

FIG. 10 shows a lighting device 31 in a view similar to FIG. 5 wherein the inner contour of the fluid dynamic region/air guide structure 32 is now of an hour-glass shape, i.e. the lateral walls 41 are getting narrower to the middle (regarding a vertical (z-)direction).

Figure 11:
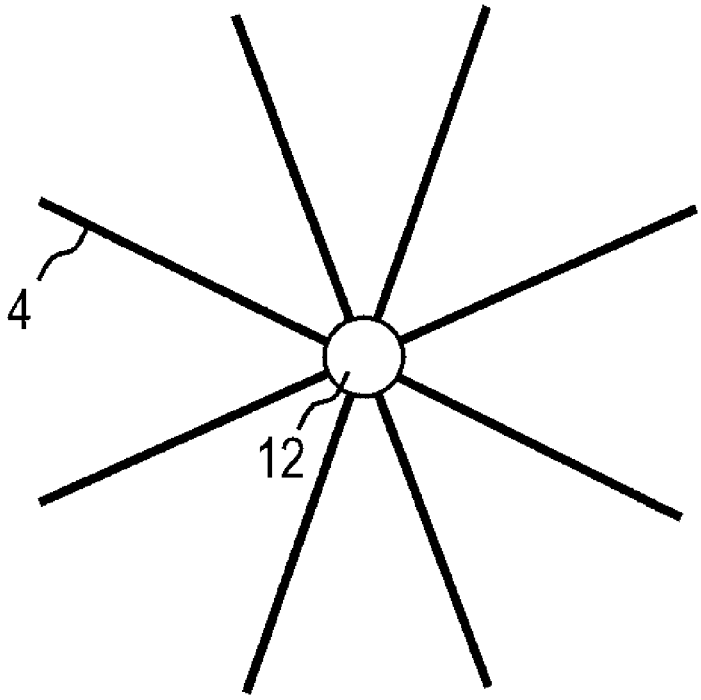
FIG. 11 is a bottom view showing sketches of a shape of cooling fins.
Figure 12:
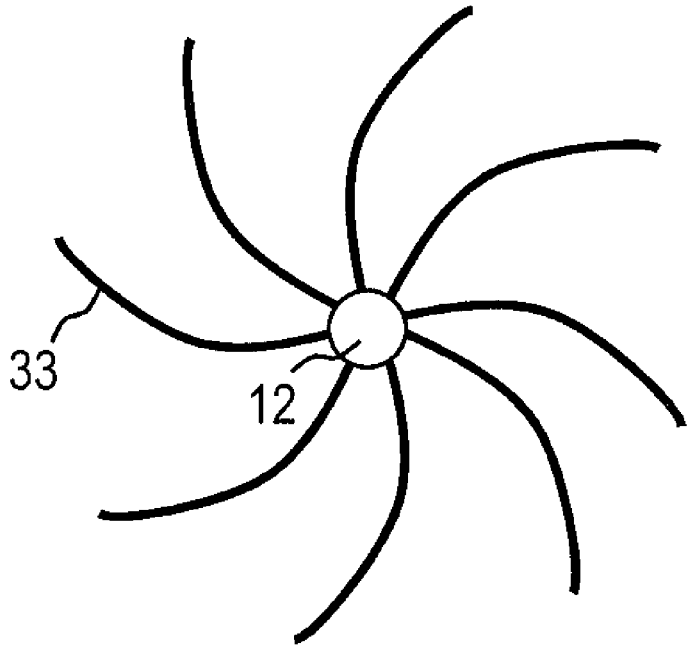
FIG. 12 is a bottom view showing a further shape of cooling fins as a bottom view.

FIG. 11 and FIG. 12 show different basic curvatures of the fins if viewed from below, namely fins 4 laterally extending in a straight manner from the heat sink base centre 12 and fins 33 extending squirt-shaped. Of course, the size of the area of the heat sink base centre 12 may vary and even be point shaped or not extending to the bottom edge of the fins 4, 33 at all.

Figure 13:
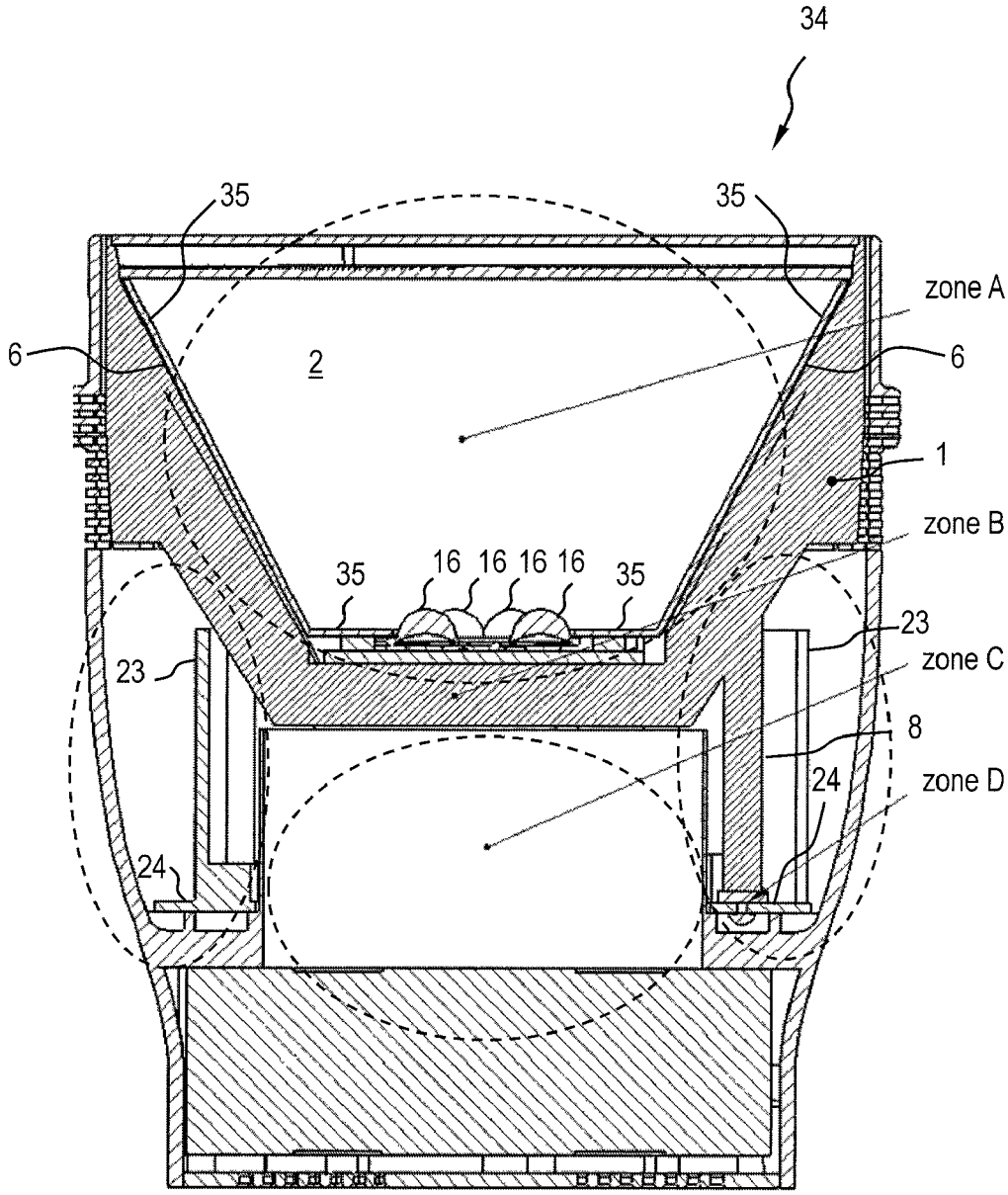
FIG. 13 shows a cross-sectional side view of a third embodiment of a lighting device.

FIG. 13 shows a lighting device 34 in a cross-section similar to FIG. 5 but through one of the mounting columns 8. The lighting device 34 of FIG. 13 differs slightly from the lighting device 14 of FIG. 5 in that no air baffle is present and in that the reflection region of the heat sink 1 now comprises a reflective layer 35 covering the cavity wall 3 except for the region containing the LEDs 16. The shape and function of the other components remains the same.

The lighting device 34 is now described in terms of four functional zones, i.e., zone A to zone D, being introduced as structural regions and functional reference for other components of the lighting system 34, e.g., the fan 21. The zones concept is especially useful for describing a multi-functionality of the heat sink 1 that comprises many interconnected functions like that of an optical interface (zone A), a thermal [conduction and convection] interface (zone B), interface with forced air flow (zone C), and an external mechanical fixing, e.g., with driver boards 23 and further components [e.g., the fan 21 and initial air development region (air guidance region 32] (zone D). The heat sink 1 is easily scalable and integratable, enabling a compact LED lighting system 34.

Figure 14:
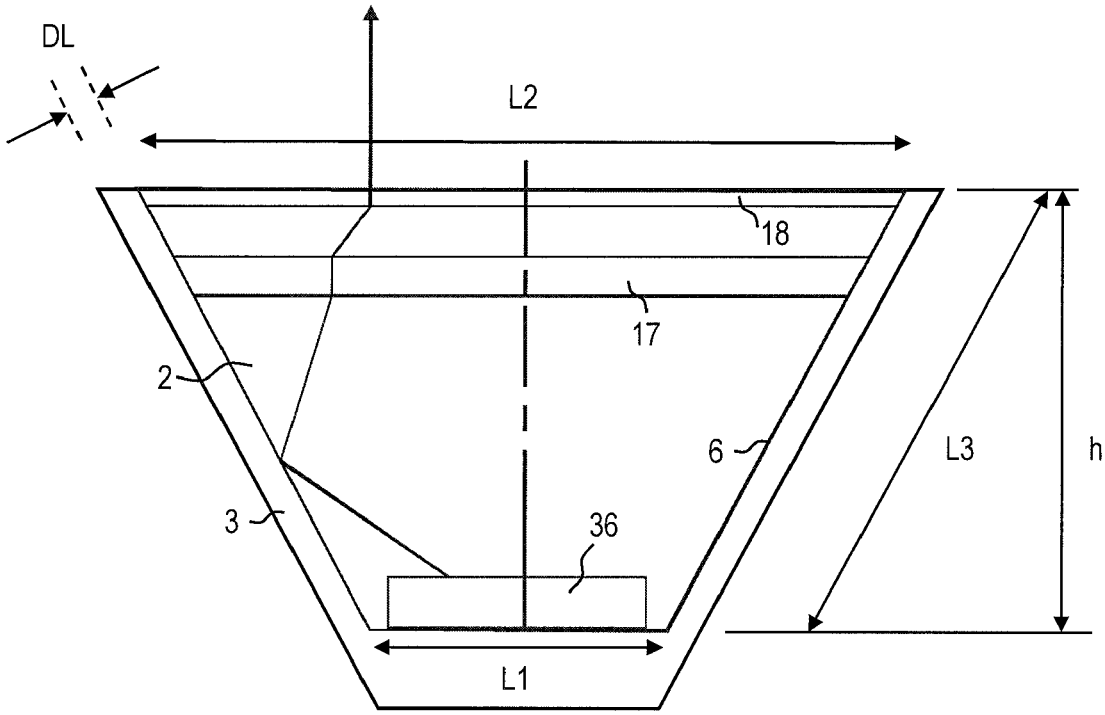
FIG. 14 shows dimensional relationships concerning the lighting device of FIG. 13.

Illumination zone (or region) A, as it is also coarsely sketched in FIG. 14, comprises a basically cross-sectional trapezoid shape of the heat sink cavity 2 wherein L1 is a minor (bottom) side on which the light source 36 (e.g., a LED submount) could be placed and centred; L2 is the size of the final emitting surface after the several optical layers 17, 18 collimation, L3 is the length of the internal lateral heat sink side surface 6 (lateral cavity wall 6) that is used and modelled as an optical reflector. Rt is the ratio of L2/L1 and typically ranges from 1.25 to 5 depending on the source 36 dimension and heat sink dissipation area needed (Rt in FIG. 14 is roughly equal to 2 due to a required radiation pattern and to the maximum diameter of the respective lamp standard).

Cooling zone (or region) B comprises the metal lamellar heat sink structure 1 that internally sustains the mounted LED light source 36 in zone A and provides an efficient heat dissipation (passive and active). The thickness DL=F2+Dw of the lateral region of the heat sink 1 is designed according to the maximum area available for the fixed outline dimensions and is geometrically related to the source 36 dimension. Typically, DL=L1/n holds, wherein n is proportional on the wattage and the dimension of the source and typically lies a range of about 0.5, . . . , 10. For high wattage LED light sources 36, n should be in the lower range. For example, as shown sketched in FIG. 14, a source power of 40 W, L1=40 mm, and n=2.7 (high power source) yields a favourable DL of about 10 mm.

Zone C (see FIG. 13) is used as an air guide 20, 32 to the heat sink 1. The height of this guide 20, 32 may be adjusted to set the laminarity (Reynolds number) of the air flow from the fan 21 to the heat sink 1. The height Hg of the air guide 20, 32 may be adjusted imposing a minimum dimension that is related to the height of the fan placed below the guide, e.g., half of the height of the fan 21. This minimum dimension is able to provide a laminar profile of the air velocity optimizing the density and maintaining the Reynolds number before the transition zone. By setting the length of the mounting columns 8, a distance between the heat sink 1 and the fan 21 can be easily and precisely set, avoiding adjustment during assembly. The columns 8 thus act as spacer elements.

Figure 15:
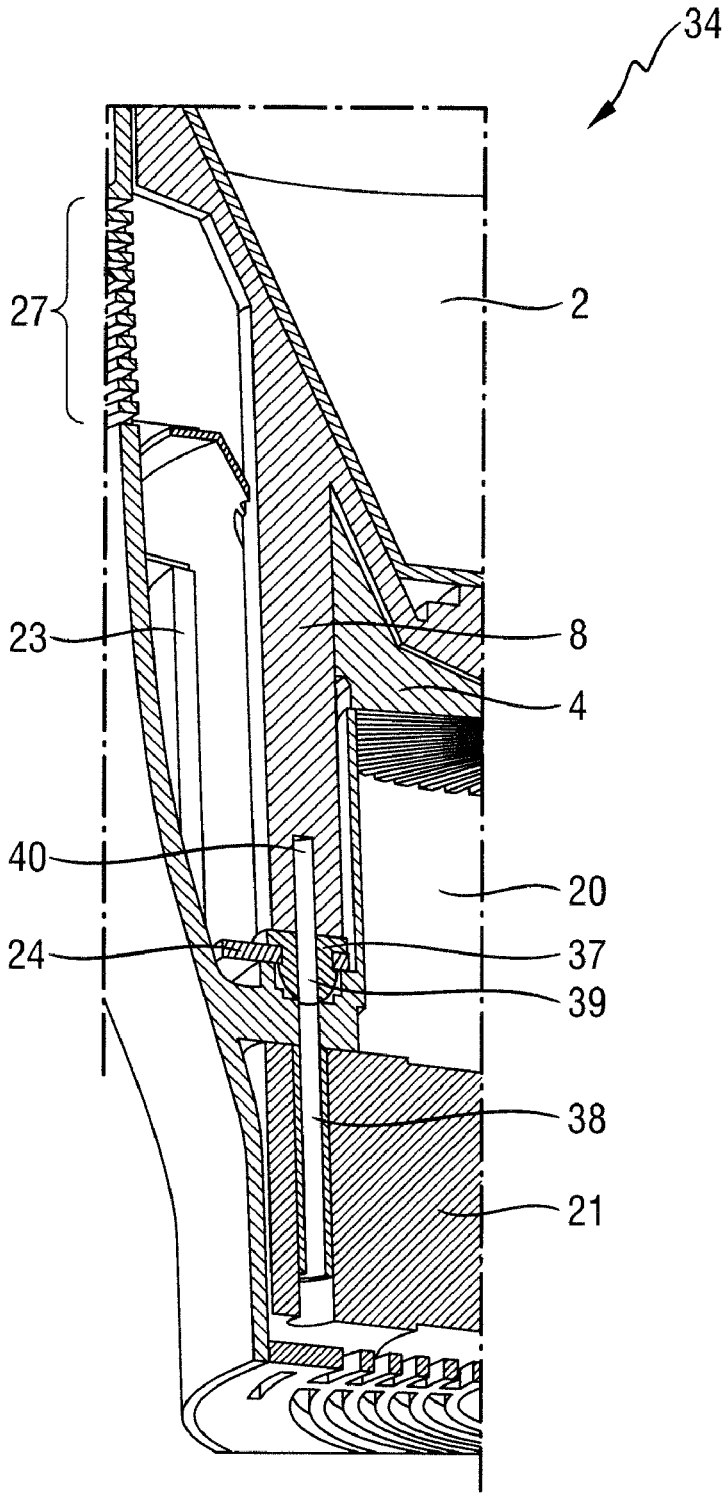
FIG. 15 shows a detailed cut-out of the lighting device of FIG. 13.

In the zone D, as shown in FIG. 15, the heat sink 1 provides the mounting columns 8 for the external fixing as well as, located onto the free end (head) of the column 8, an additional coaxial plastic part or element 37 able to provide a stable mounting of the driver boards 23 by fixing the PCB support 24, as well as low tolerances, mechanical absorption and electrical insulation. The plastic element 37 is fixed into the columns by mechanical interference. This plastic element 37 presents two important functions. The first function is to orienteer and fix the driver boards 23 by means of coaxial holes before (mechanical interference) the complete final mounting of the lighting device 34. The second function is to provide an electrical insulation between the heat sink 1 and the driver boards 23 (and support 24, resp.); to that extend a thickness of the plastic element 37 is in the range of 1.2-1.8 [mm]. For easy assembly, the support 24 may first be pressed onto the plastic elements 37 as thus be positionally fixed before attaching the housing 28. The same column 8 may also be used for fixing additional components (for example, the fan 21) for active thermal dissipation. To this extend, the fan 21, the plastic element 37, and the mounting column 8 all have boreholes 38, 39, and 40, resp., as shown, and aligned to each other and adapted to receive a fastening element, e.g., a bolt or screw; the borehole 40 of the column 8 then preferably being threaded.

Of course, the invention is not limited to the shown exemplary embodiments.

For example, light sources other than an LED may be used. More than one Submount may be used. The base may have other shapes, e.g., be of rectangular cross-sectional shape, e.g. depending on the air flow generator. Also, the forced air flow generator may not be a fan but, e.g., comprise a vibrating membrane. Further, the air guide structure 20 may comprise structured air flow channels.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

Additionally, please cancel the originally-filed Abstract of the Disclosure, and add the accompanying new Abstract of the Disclosure which appears on a separate sheet in the Appendix.

LIST OF REFERENCE NUMBERS

1 heat sink
2 cavity
3 cavity wall
4 vertical fin
5 rim
6 interior lateral cavity wall
8 mounting column
9 step
10 connector cut-out
11 heat sink base
12 heat sink base centre
13 bottom of the cavity
14 lighting device
15 substrate
16 LED
17 Fresnel lens
18 micro lens array
19 lateral air outlet opening
20 fluid dynamic region/air guidance structure
21 forced air flow generator
22 air intake opening
23 printed circuit board
24 support
25 air baffle
26 air flow channel
27 air flow exit
28 housing
29 fin
30 fin
31 lighting device
32 fluid dynamic region/air guide structure
33 fin
34 lighting device
35 reflective layer
36 light source
37 plastic insulation element
38 borehole
39 borehole
40 borehole
41 sidewall
L1 diameter at the bottom of the cavity
L2 diameter at the top of the cavity
h height of the cavity walls
Lt heat sink top width
Lc heat sink base centre width (apex width)
Hb heat sink base height
F1 thickness of a fin
F2 lateral length of a fin
C1 thickness of an air flow channel
Hc overall height of an air flow channel
He height of the lateral air flow exit
Dw thickness of the cavity wall
Hg height of the air guide structure

The invention claimed is:

1. A heat sink, comprising:

an open cavity formed by a cavity wall, a cavity bottom wall thereof comprising a light source region adapted to have a light source mounted thereon and a lateral cavity wall thereof comprising a reflection region adapted to reflect light emitted from the light source;

a heat spreading and dissipation structure covering at least art of an exterior of the heat sink including a bottom region and a lateral region, the heat spreading and dissipation structure comprising a plurality of vertically aligned fins;

an air guidance structure adapted to separate the heat sink from an air flow generator; and at least one mounting column for attaching the heat sink to a lighting device.

2. The heat sink according to claim 1, wherein the light source comprises at least one LED submount.

3. The heat sink according to claim 1, wherein at least one of the following conditions hold:

a height of the cavity ranges between 30 mm and 80 mm;

a width of the cavity bottom ranges between 20 mm and 60 mm;

a width of the top of the cavity ranges between 80 mm and 120 mm;

a ratio Rt of a width of the top of the cavity and a width of the cavity bottom lies in the range of $1.25 \leqq Rt \leqq 5$; and a thickness Dw of the lateral cavity wall is in the range of $0.5\ mm \leqq Dw \leqq 10\ mm$.

4. The heat sink according to claim 1, comprising at least three mounting columns that are arranged in a non-symmetrical manner.

5. The heat sink according to claim 1, wherein the at least one mounting column is adapted to secure at least one printed circuit board.

6. The heat sink according to claim 1, wherein the heat spreading and dissipation structure comprises at least one air flow channel leading from the bottom region to the lateral region, the air flow channel comprising a lateral exit.

7. The heat sink according to claim 1, wherein the heat sink comprises a solid heat sink base extending from the light source region to the exterior and protruding from the cavity wall; and wherein the heat spreading and dissipation structure is in thermal connection with the heat sink base.

8. The heat sink according to claim 7, wherein at least one of the following conditions hold:

a base width Lt of the heat sink base is in the range of $L1 \leqq Lt \leqq 1.5 \cdot L1$;

an apex width Lc of the heat sink base is in the range of $0 \leqq Lc \leqq L1$;

a height Hb of the heat sink base is in the range of $0.05 \cdot L1 \leqq Hb \leqq 0.5 \cdot L1$;

a circumferential distance C1 between two adjacent fins is in the range of 0.4 mm$\leqq$C1$\leqq$8 mm;

a thickness F1 of the fins is in the range of 0.1 mm$\leqq$F1$\leqq$3 mm; and a lateral length F2 of the fins is in the range of 5 mm$\leqq$F2$\leqq$40 mm;

wherein L1 denotes a width of the cavity bottom.

9. A lighting device, comprising:

a heat sink, the heat sink comprising:

an open cavity formed by a cavity wall, a cavity bottom wall thereof comprising a light source region adapted to have a light source mounted thereon and a lateral cavity wall thereof comprising a reflection region adapted to reflect light emitted from the light source;

a heat spreading and dissipation structure covering at least part of an exterior of the heat sink including a bottom region and a lateral region, the heat spreading and dissipation structure comprising a plurality of vertically aligned fins;

an air guidance structure adapted to separate the heat sink from an air flow generator; and at least one mounting column for attaching the heat sink to a lighting device.

10. The lighting device according to claim 9, further comprising:

an air flow generator adapted to supply a forced air flow to the bottom of the heat sink;

wherein the air flow generator is positioned below the heat sink and spaced apart from the heat sink by the air guidance structure.

11. The lighting device according to claim 10, wherein the air guidance structure comprises an open space having a shape selected from a group consisting of: a basic shape of a straight tube; and an hourglass shape.

12. The lighting device according to claim 9, wherein a height of the air guidance structure is in the range between a half of a height of the forced air flow generator and twice the height of the forced air flow generator.

13. The lighting device according to claim 9, further comprising:

a support adapted to support at least one printed circuit board, wherein the support is of circular shape and positioned around one out of the air guidance structure and the forced air flow generator.

14. The lighting device according to claim 13, wherein at least one printed circuit board is perpendicularly attached to the support.

15. The lighting device according to claim 14, wherein a plurality of printed circuit boards is arranged symmetrically around a longitudinal axis of the lighting device.

* * * * *

UNITED STATES PATENT AND TRADEMARK OFFICE

CERTIFICATE OF CORRECTION

PATENT NO. : 8,322,892 B2
APPLICATION NO. : 12/746533
DATED : December 4, 2012
INVENTOR(S) : Scordino et al.

It is certified that error appears in the above-identified patent and that said Letters Patent is hereby corrected as shown below:

In the Specification

In column 11, please cancel superfluous lines 32 to 35: "Additionally, please ... in the Appendix.".

In the Claims

In column 12, line 35, claim 1, please replace "art" by "part".

Signed and Sealed this
Sixteenth Day of June, 2015

Michelle K. Lee

Michelle K. Lee
*Director of the United States Patent and Trademark Office*